United States Patent [19]

Ellson

[11] 3,933,333

[45] Jan. 20, 1976

[54] CLAMP FOR CONCRETE FORMS

[76] Inventor: Douglas G. Ellson, 209 S. Hillsdale Drive, Bloomington, Ind. 47401

[22] Filed: Dec. 23, 1974

[21] Appl. No.: 535,954

[52] U.S. Cl. ..... 249/43; 249/216; 269/321 S
[51] Int. Cl.[2] ..... F04G 17/06
[58] Field of Search ..... 249/40, 43, 46, 190, 216; 269/321 S; 254/104

[56] References Cited

UNITED STATES PATENTS

| | | | |
|---|---|---|---|
| 2,709,292 | 5/1955 | Otti | 249/216 |
| 3,057,034 | 10/1962 | Melmick | 249/213 |
| 3,167,842 | 2/1965 | Pauli | 254/104 |
| 3,417,958 | 12/1968 | Rugger | 249/216 |
| 3,841,600 | 10/1974 | Aubee | 249/43 |

*Primary Examiner*—Al Lawrence Smith
*Assistant Examiner*—Robert C. Watson
*Attorney, Agent, or Firm*—Woodard, Weikart, Emhardt & Naughton

[57] ABSTRACT

Disclosed is a clamp or tie rod assembly which can be inserted and withdrawn from one side of spaced form members between which concrete or the like is to be poured. The assembly includes a removable shaft and an eccentrically bored spacer accommodated on the shaft prior to its insertion between the forms. The spacer is left imbedded in the concrete when the shaft is later withdrawn at the time the forms are to be removed from the concrete.

5 Claims, 5 Drawing Figures

CLAMP FOR CONCRETE FORMS

BACKGROUND OF THE INVENTION

The cost of poured concrete construction is currently high because of the cost of material, such as multiple heavy wooden uprights, braces and ties which are required to support the forms and maintain accurate spacing between them and because of the labor cost incurred in constructing and removing these supports. Cost is further increased by the fact that access to one side of the form is often difficult or impossible to achieve. If the concrete is to be poured below ground level the excavation must be widened by several feet to provide the space necessary to build the outside supporting structure, and after the structure is removed the additional space must be backfilled. If the concrete is to be poured more than a few feet above ground, construction of the necessary supporting structure on the outside of the building and its subsequent removal may be vary costly and dangerous to workmen.

Concrete form tie rods or clamps of various types are well known in the prior art. Insertion, or installation and removal of the prior art clamps conventionally require access to both sides of the form. An example of such prior art structures is disclosed in U.S. Pat. No. 2,320,869. The clamp assembly of the present invention can be installed and removed from one side of the form. Except for the spacer member, which is left imbedded in the poured concrete, the clamp may be withdrawn and reused. The clamp assembly is simply constructed but, used at spaced intervals over the form, the two sides of the form are rigidly held in place in three dimensions with a precisely determined space between the sides of the form.

DESCRIPTION OF THE PREFERRED EMBODIMENT

Figure 1:
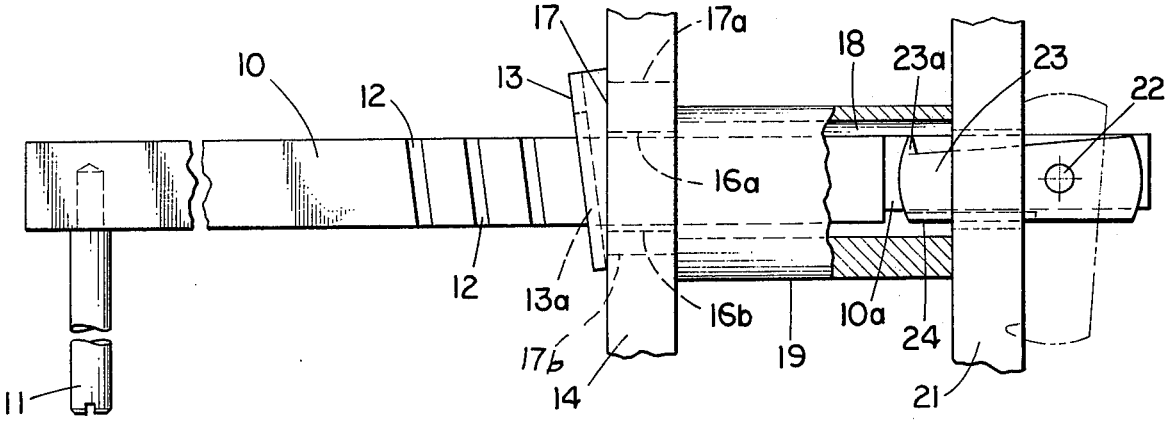
FIG. 1 is a side view of the clamp assembly installed on a form.
Figure 2:
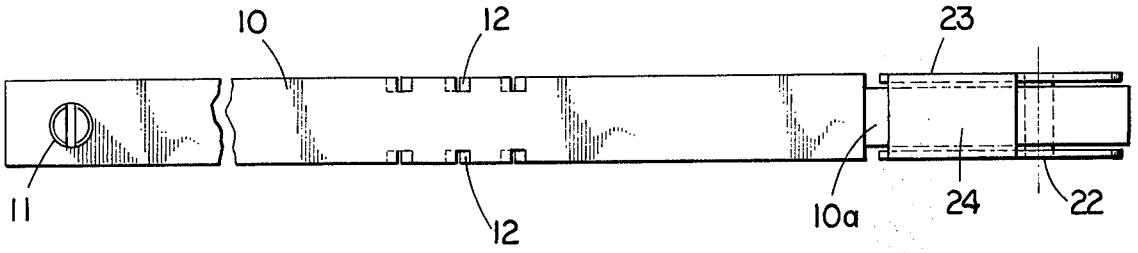
FIG. 2 is a bottom view of the shaft component.

Referring initially to FIGS. 1 and 2, the assembly includes a shaft 10 formed of square bar stock, having a sidewardly extending handle 11 attached adjacent the free end of the shaft to facilitate its manual rotation for the installation and removal of the shaft as will be subsequently described. The shaft is provided with a series of inclined notches 12 along two of its opposite sides into which may be driven the inwardly extending flanges 13*a* of a U-shaped wedge member 13. The wedge member engages the side face of the form member 14 and the shaft 19 extends through an aperture 16 (FIG. 3) whose margins are indicated by the broken lines identified at 16*a* and 16*b* in FIG. 1.

Figure 3:
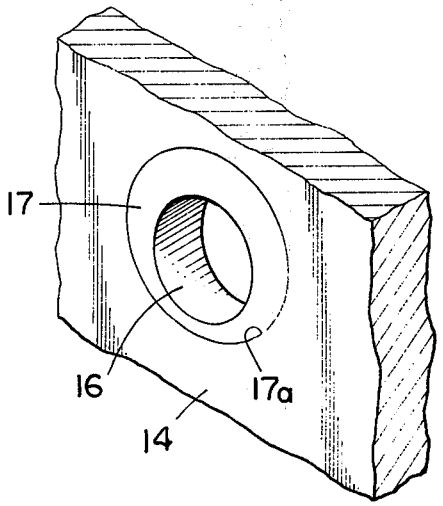
FIG. 3 is a perspective view of a fragment of the form being prepared for installation of the assembly.
Figure 5:
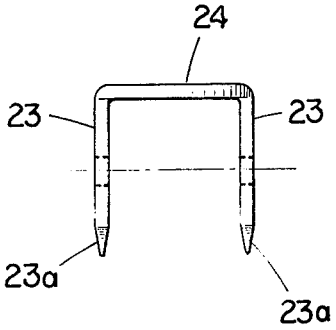
FIG. 5 is an end view of the toggle arm.

As may be seen in FIG. 3, the aperture 16 in the near form member 14 is drilled and, subsequently, a larger aperture is formed by a circle cutter, the larger aperture, whose perimeter is indicated at 17*a* in FIG. 3, being formed upon the removal of the plug 17 cut by the circle cutter. As will subsequently be explained, this plug 17 is removed for initial insertion of the shaft but is replaced after the shaft and accompanying parts carried by it have been inserted, the plug serving to enclose the space between the shaft and the larger aperture whose perimeter is indicated at 17*a* in FIG. 3 (the lower margin of the aperture being indicated at 17*b* in FIG. 1).

The shaft 10 extends freely through a passage 18 formed to extend longitudinally through a spacer 19 which has a cylindrical configuration, the passage 18 having its centerline displaced radially from the centerline of the cylinder 19. The spacer engages the inner face of the other form member indentified at 21 in FIG. 1 and the length of the spacer 19 is predetermined so as to provide the desired spacing between the near form member 14 and the far form member 21.

As will be evident in comparing FIGS. 1 and 2, the shaft 10 has an end portion 10*a* of reduced dimension and pivotally supported, by means of the pin 22, on this shaft portion 10*a* is a generally U-shaped latch or toggle member having extending arms 23 and a portion 24 bridging the arms. A sharpened spur 23*a* extends from the free end of each of the arms 23. The latching member formed by the toggle arms 23 is shown in deactuated position in solid lines in FIG. 1 and is shown in its alternate, actuated position in broken lines in FIG. 1, the function of the positions of the toggle arms being subsequently described.

In operation, initially, an aperture 16 is drilled in the form member 14 and a registering aperture drilled in the far form member 21, the apertures having a size just sufficient to freely accommodate the shaft 10. A circle cutter is then utilized to cut the larger aperture whose perimeter is indicated at 17*a* in FIG. 3 and the plug 17 is removed and retained. The plug 17 is then placed on the shaft by inserting it through the aperture 16 and the shaft is then inserted through the aperture 18 in the spacer member 19. The spacer member 19 is oriented on the shaft so that its thicker portion is at the bottom of the shaft (the position shown in FIG. 1). The shaft and spacer 19 are then inserted through aperture 17*a* in form 14, and, after spacer 19 clears the form 14, the shaft is moved downwardly to a position in which it registers with the aperture in form 21. The thicker portion of the spacer will then be interposed between opposite surfaces of forms 14 and 21 as shown in FIG. 1.

Figure 4:
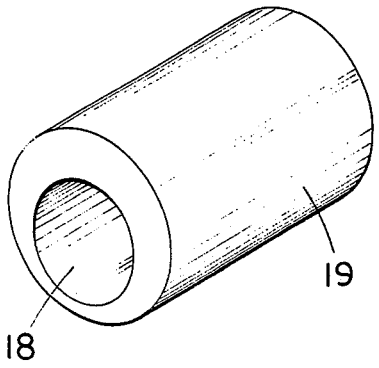
FIG. 4 is a perspective view of the spacer component of the assembly.

The shaft 10 is further pushed rightwardly as viewed in FIG. 1 until the free end of the toggle arms 23 clears the outer surface of the form member 21. With the shaft oriented as shown in FIG. 1, the toggle arms will then fall by gravity through substantially 90° to a generally vertical position (shown in broken lines in FIG. 1). This defines the actuated position of the toggle arms 23 and the shaft 10 may then be pulled sharply leftwardly so as to embed the spur portion 23*a* of the toggle arms into the form 21. The plug 17, the first member placed on the shaft at the start of the process, may then be inserted into the aperture whose perimeter is indicated at 17*a* thus closing the space between the shaft and the larger aperture necessary to accommodate the spacer 19. It will be noted from FIG. 4 that the thicker portion of the stop 17 is above the shaft axis and the thicker portion of the spacer 19 is below the shaft axis. The shaft 10 is then pulled leftwardly as viewed in FIG. 1 and the form 14 is pushed rightwardly as viewed in FIG. 1 as far as possible and the wedge 13 is inserted in the particular slot 12 which is nearest the form. Driving the wedge 13 downwardly serves to tighten both form members 14 and 21 against the adjacent end faces of the spacer 19. The concrete or other flowable material may then be poured into the space between the form members.

Subsequently, after the concrete has hardened, to remove the clamp, the wedge 13 is removed and the shaft 10 is pushed forward or rightwardly as viewed in FIG. 1 so that the toggle arm spurs 23*a* are removed from the form 21. The shaft 10 is then rotated manually through approximately 180°. The toggle arms will then fall back to their deactuated position (shown in solid lines in FIG. 1) and the shaft may then be withdrawn from the form members. After the shaft has been removed the form members with the plug 17 may be removed and, unless needed for drainage, the passage 18 through the spacer 19 may be filled with mortar or other filler.

The tip of the shaft might be modified to present a drill bit to the form members so that the shaft, itself, could be utilized to form the registering apertures in the form members. In such an arrangement the left end portion (as viewed in FIG. 1) of the shaft would be formed into a crank configuration to facilitate the more prolonged manual rotation which would be required for drilling the apertures. Other forms of the latching means might be utilized, including spring released latches, however, the toggle arm arrangement disclosed herein is simple and trouble-free in construction and operation.

I claim:

1. A clamp assembly for maintaining form members in predetermined spaced position during the depositing of flowable material between the members, said assembly including a shaft freely inserted into an enlarged aperture in the outer face of one form member, across the space between said form members and freely through an aperture of smaller dimension in the other form member, a spacer on the shaft having an outer transverse dimension smaller than said enlarged aperture but larger than said smaller aperture and a longitudinal dimension substantially equal to said predetermined space between the forms, an eccentric passage formed in and extending longitudinally through said spacer freely accommodating said shaft, whereby said spacer member is passed through said enlarged aperture with said shaft when oriented in one position with relation to the shaft axis and blocked from withdrawal through said enlarged aperture when oriented in another position with relation to the shaft axis, latching means on the remote end of said shaft which can be selectively actuated to prevent withdrawal of the shaft from said aperture in the other form member and deactuated to permit withdrawal, a plug member on said shaft for closing the space between said shaft and the margin of said enlarged aperture, and releasable means cooperating with said shaft to press said one form member against the adjacent end face of said spacer, whereby after deposit of the flowable material between said members, said latching means may be deactuated, said releasable means released and said shaft withdrawn for reuse leaving said spacer in situ between said members.

2. A clamp assembly as claimed in claim 1 in which both said enlarged aperture and said smaller dimensioned aperture are circular in configuration and said spacer is of cylindrical configuration with the longitudinal axis of said eccentric passage being displaced radially from the central longitudinal axis of the cylindrically configurated spacer.

3. A clamp assembly as claimed in claim 1 in which said spacer is moved from its said one position to its said other position by rotating it on said shaft through approximately 180°.

4. A clamp assembly as claimed in claim 1 in which said latch means includes at least one toggle arm pivotally supported between its ends on said shaft adjacent the remote end thereof, a stop cooperating with said shaft and arm for limiting the pivotal motion of the arm with respect to the shaft to approximately 90°, the weight of the portion of said arm on one side of said pivotal support being greater than that on the other side whereby said arm may drop by gravity into actuated position transverse to said shaft and, upon axial rotation of said shaft through approximately 180°, is returned by gravity into deactuated position aligned with said shaft.

5. A clamp assembly as claimed in claim 4 in which the free tip of said toggle arm is provided with a spur imbedded in the outer surface of said other form member when said toggle arm is in actuated position.

* * * * *